United States Patent [19]

Smith

[11] 3,990,261

[45] Nov. 9, 1976

[54] AIR CONDITIONING UNIT

[75] Inventor: Gerald C. Smith, New Braunfels, Tex.

[73] Assignee: Weil-McLain Co., Inc., Dallas, Tex.

[22] Filed: Nov. 5, 1975

[21] Appl. No.: 628,937

[52] U.S. Cl. ..... 62/262; 62/263; 62/507

[51] Int. Cl.[2] ..... F25D 23/12; F25B 39/04

[58] Field of Search ..... 62/262, 263, 507, 508

[56] References Cited

UNITED STATES PATENTS

| | | | |
|---|---|---|---|
| 2,945,359 | 7/1960 | MacLeod | 62/262 |
| 2,945,360 | 7/1960 | Tyler | 62/262 |
| 2,984,089 | 5/1961 | Whitesel | 62/507 |
| 2,986,016 | 5/1961 | Gillham et al. | 62/507 |
| 2,999,370 | 9/1961 | Eberhart | 62/262 |
| 3,213,636 | 10/1965 | MacLeod | 62/262 |
| 3,477,211 | 11/1969 | Pietsch | 62/262 |
| 3,566,614 | 3/1971 | Imral | 62/262 |

*Primary Examiner*—Lloyd L. King
*Attorney, Agent, or Firm*—Lane, Aitken, Dunner & Ziems

[57] ABSTRACT

An air conditioning unit in which a housing is provided having side walls adapted to extend within an opening formed in an exterior wall of a room to be cooled. Air inlet and outlet means are associated with the front wall and rear walls of the housing to circulate room air and ambient air through the unit. A condenser heat exchanger and an evaporator heat exchanger are disposed in the housing in proximity to its rear wall and front wall, respectively, and extend at an angle relative to the latter walls. Ambient air is circulated into the inlet associated with the rear wall, across the condenser heat exchanger and out the outlet associated with the rear wall, and room air is circulated through the inlet associated with the front wall, across the evaporator heat exchanger and out the outlet associated with the front wall.

7 Claims, 2 Drawing Figures

AIR CONDITIONING UNIT

BACKGROUND OF THE INVENTION

The present invention relates to an air conditioning unit and, more particularly, to a self-contained air conditioning unit which is adapted for installation relative to an exterior wall of a room or area to be cooled.

One of the most important design goals in a single room, self-contained air conditioner is to reduce the size of the unit as much as possible, yet maintain an acceptable capacity. It is thus particularly important that the efficiency of the unit be high in order to provide a maximum capacity for each design.

In typical designs of this type, the condenser heat exchanger and the evaporator heat exchanger are positioned parallel to the rear wall and front wall of the unit and to the room wall. Ambient air is drawn in through the rear wall of the unit and turns approximately 180° before it passes across the condenser coil and discharges through the open air passage side of the rear wall. This type of flow pattern restricts the air flow through the condenser and thus reduces the efficiency of the system. Also, short circuiting of the condenser air discharge to the condenser air inlet is prevalent in these type designs which further reduces the condenser efficiency by increasing the ambient air temperature entering the condenser.

In other designs of this type, an inlet for ambient air is provided through the side wall of the unit. However, as in the systems discussed above, the air flow pattern extends for as much as 180° from its direction of entry into the unit to its direction of discharge from the unit. Also, the condenser air discharge often short circuits back to the condenser air inlet as discussed above, which further reduces the efficiency of the unit.

The above problems associated with the condenser section of the unit may also exist in the evaporator section, for the same reasons as discussed above.

SUMMARY OF THE INVENTION

It is therefore an object of the present invention to provide an air conditioning unit which enjoys an increased efficiency when compared to the previous designs discussed above.

It is a further object of the present invention to provide an air conditioning unit in which the flow paths of the air discharging from the condenser heat exchanger and the evaporator heat exchanger extend at relatively small angles to the respective flow paths of the air discharging from the heat exchangers when compared to prior art designs discussed above.

It is a further object of the present invention to provide an air conditioning unit of the above type in which the heat exchangers are disposed at an angle relative to the front and rear walls of the unit to permit the above-mentioned air flow patterns.

Toward the fulfillment of these and other objects, the air conditioning unit of the present invention comprises a housing having a front wall, a rear wall and two side walls, the housing adapted to be mounted relative to a wall of a room to be cooled with the side walls extending within an opening formed in the room wall, the rear wall extending parallel to the room wall and exposed to ambient air and the front wall extending parallel to the room wall and exposed to the room to be cooled; a condenser heat exchanger disposed in the housing in proximity to the rear wall; an evaporator heat exchanger disposed in the housing in proximity to the front wall; at least one of the heat exchangers extending at an angle relative to the front and rear walls; first air inlet and outlet means associated with the front wall; second air inlet and outlet means associated with the rear wall; and fan means disposed in the housing for circulating ambient air into the first inlet means, across the condenser heat exchanger and out the first outlet means, and for circulating room air through the second inlet means, across the evaporator heat exchanger and out the second outlet means.

DESCRIPTION OF THE PREFERRED EMBODIMENT

Figure 1:
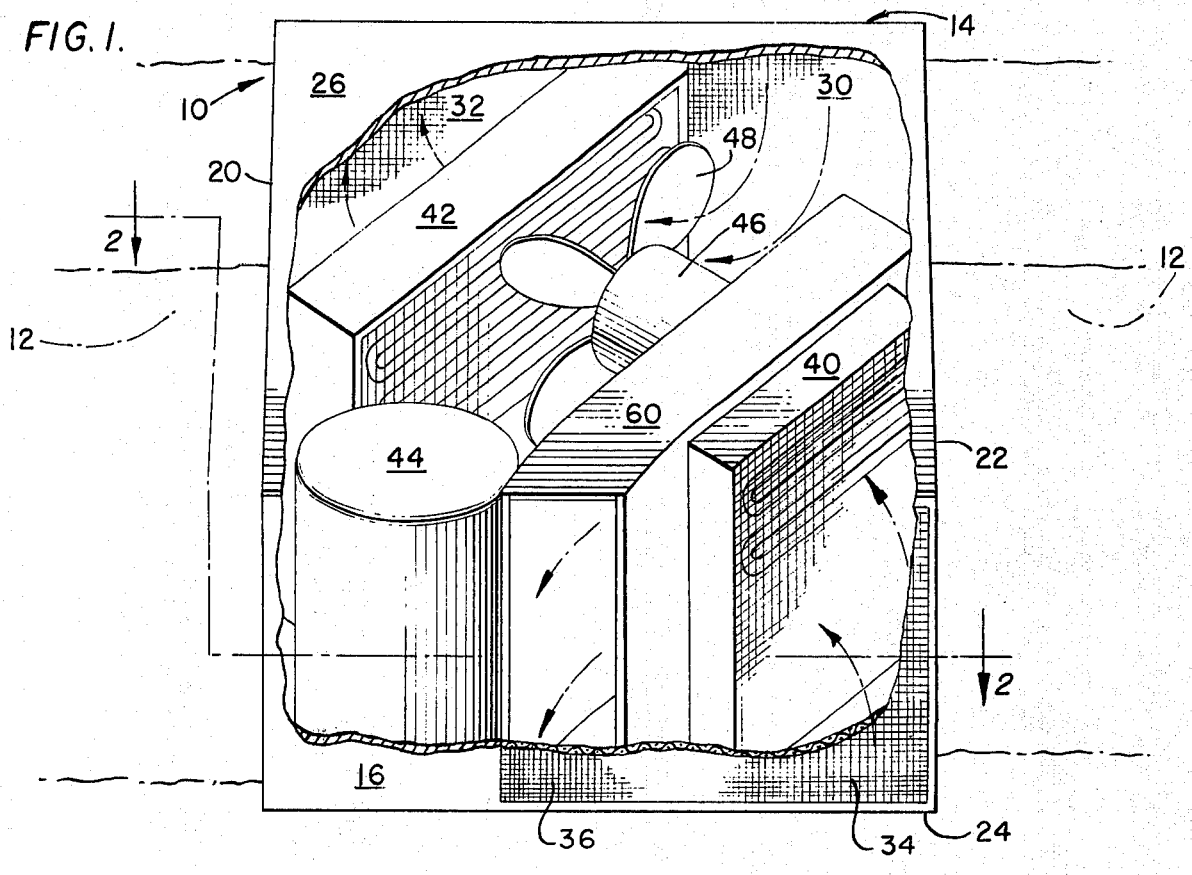
FIG. 1 is a perspective view of the air conditioning unit of the present invention.
Figure 2:
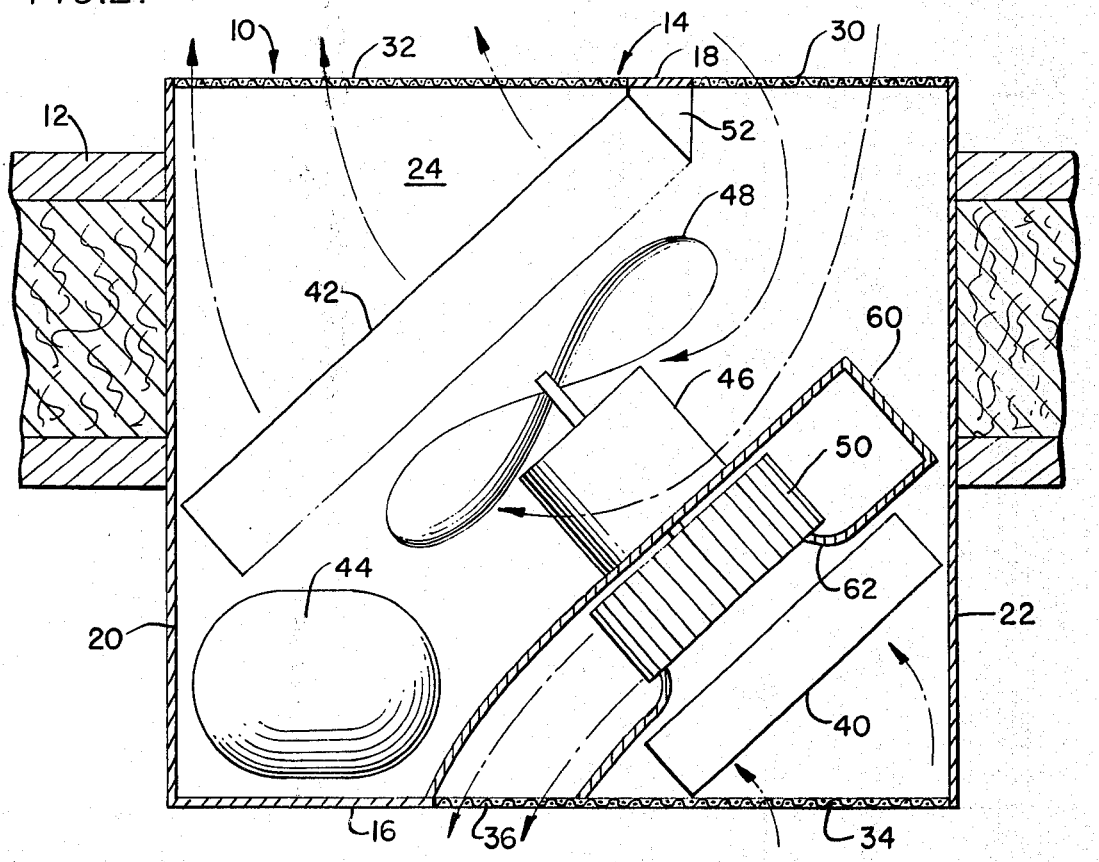
FIG. 2 is a cross-sectional view taken along the line 2—2 of FIG. 1.

Referring specifically to the drawings, the reference numeral 10 refers in general to the air conditioning unit of the present invention which is shown mounted relative to an opening formed in an exterior wall 12 of a room or area to be cooled. The unit 10 consists of a housing, shown in general by the reference numeral 14, and formed by a front wall 16 which extends within the interior of the room to be cooled, and a rear wall 18 which extends outwardly from the wall 12 and which is exposed to ambient air. Two sidewalls 20 and 22 are each connected to the front wall 16 and the rear wall 18 and snugly fit within the opening formed in the wall 12, where they are attached by conventional means. The housing 14 is completed by a bottom 24 and a cover 26 which, along with the walls 16, 18, 20, and 22, can be fabricated from sheet metal or the like in a conventional manner.

An ambient air inlet 30 is provided through the rear wall 18 and is formed by an opening in the latter wall covered by a porous material of a conventional design to enable the ambient air to pass inwardly into the housing 14. An ambient air outlet 32 is also provided in the rear wall 18, adjacent the inlet 30 and a room air inlet 34 and outlet 36 are provided in the front wall 16, in a similar manner.

An evaporator heat exchanger 40 and a condenser heat exchanger 42 are disposed in the housing 14 proximate to the front wall 16 and the rear wall 18, respectively. A compressor 44 is disposed in the housing 14 and is located in a continuous circuit for the flow of heat exchange fluid, including the coils associated with the heat exchangers 40 and 42 and auxiliary components normally associated with this type design. Since this circuit may be of a conventional design, it is not shown in detail.

An electric motor 46 is provided in the housing 14 between the heat exchangers 40 and 42 and has an output shaft extending out from both ends thereof and drivingly connected to an impeller fan 48 and a centrifugal fan 50. The fan 48 extends between the motor 46 and the condenser heat exchanger 42 and a partition 52 extends from one side portion of the latter heat exchanger to the wall 18. As a result, the fan 48 operates to force ambient air into the housing 14 through the inlet 30, across the heat exchanger 42 and outwardly through the outlet 32.

The fan 50 extends between the motor 46 and the evaporator heat exchanger 40 and a partition type housing 6 encloses a portion of the fan 50 and defines an air inlet 62. As a result, the fan 50 operates to draw air in through the room air inlet 34, into the inlet 62 of the housing 60, and across the heat exchanger 40, and to force the air outwardly in a radial direction relative to the fan 50, through the housing 60 and out the outlet 36.

According to a feature of the present invention, the heat exchangers 40 and 42, the motor 46, and the fans 48 and 50 are all disposed at an angle relative to the walls 16, 18, 20, and 22 and symmetrically with respect to a diagonal extending from the corners of the housing 14. As a result, the ambient air discharges through the outlet 32, and the room air discharges through the outlet 36 at an angle relative to the walls 18 and 16, respectively. Also, the flow path of the ambient air discharging through the outlet 32 extends at an angle less than 180° relative to the direction of the ambient air entering the housing through the inlet 30. Similarly, the direction of room air discharge through the outlet 36 also extends at an angle less than 180° to the direction of entry of the room air into the inlet 34. According to a preferred embodiment, the heat exchangers 40 and 42 extend at a 45° angle relative to the walls 16 and 18, respectively. As a result, the air discharges from the outlets 36 and 32 at angles of 45° to the walls 16 and 18, respectively, and at angles of 135° relative to the direction of air flow into the inlets 30 and 34, respectively. This results in a less restrictive flow path of both the room air through the evaporator heat exchanger 40, and the ambient air through the condenser heat exchanger 42 when compared to the prior art devices discussed above. The efficiencies of the condenser heat exchanger 42 and the evaporator heat exchanger 40 are thus increased, and the capacity of the unit 10 can be relatively large relative to its size.

The above design also permits the use of a relatively large face area coil associated with both heat exchangers 40 and 42 and, in addition, minimizes short circuiting of the discharge air to the entering air stream with respect to both heat exchangers.

In operation, the heat exchange fluid is passed continuously through the coils associated with the condenser heat exchanger 42 and the evaporator heat exchanger 40, the compressor 44 and the associated components. As a result of its heat exchange with the ambient air at the heat exchanger 42 and the room air at the heat exchanger 40, the heat exchange fluid removes heat from the room air before the latter is passed back into the room to cool same.

Of course, variations of the specific construction and arrangement of the air conditioning unit disclosed above can be made by those skilled in the art without departing from the invention as defined in the appended claims.

I claim:

1. An air conditioning unit comprising a housing having a front wall, a rear wall and two side walls, said housing adapted to be mounted relative to a wall of a room to be cooled with said side walls extending within an opening formed in said room wall, said rear wall extending parallel to said room wall and exposed to ambient air and said front wall extending parallel to said room wall and exposed to the room to be cooled; a condenser heat exchanger disposed in said housing in proximity to said rear wall; an evaporator heat exchanger disposed in said housing in proximity to said front wall; said heat exchangers extending in vertical planes, each of which extends at an angle relative to each of said walls; first air inlet and outlet means associated with at least one of said walls; second air inlet and outlet means associated with at least one of said walls, and fan means disposed in said housing and extending between said heat exchangers with the impeller axis of said fan means extending in a horizontal plane and substantially perpendicular to said vertical planes, said fan means adapted to circulate ambient air into said first inlet means, across said condenser heat exchanger and out said first outlet means, and to circulate room air through said second inlet means, across said evaporator heat exchanger and out said second outlet means.

2. The unit of claim 1 wherein said heat exchangers extend parallel to each other.

3. The unit of claim 2 wherein air is discharged from said first and second outlet means at an angle of approximately 45° relative to said rear and front walls, respectively.

4. The unit of claim 2 wherein said heat exchangers and said fan means are all disposed in a symmetrical relationship relative to a diagonal connecting two opposite corners of said housing.

5. The unit of claim 1 wherein the flow paths of ambient air into said first inlet means and from said first outlet means, respectively, extend at an angle of less than 180°.

6. The unit of claim 1 wherein the flow paths of room air into said second inlet means and from said second outlet means, respectively, extend at an angle of less than 180°.

7. The unit of claim 1, wherein said first air inlet and outlet means are associated with said front wall and wherein said second air inlet and outlet means are associated with said rear wall.

* * * * *